US005322275A

United States Patent [19]

Gardellini, deceased et al.

[11] Patent Number: 5,322,275

[45] Date of Patent: Jun. 21, 1994

[54] BILL ACCUMULATING AND STACKING DEVICE

[75] Inventors: Vedasto Gardellini, deceased, late of Suffolk County; by Maria Gardelline, heiress, Commack, both of N.Y.

[73] Assignee: Coin Bill Validator Inc., Deer Park, N.Y.

[21] Appl. No.: 771,189

[22] Filed: Oct. 4, 1991

[51] Int. Cl.[5] ..... B65H 29/38

[52] U.S. Cl. ..... 271/306; 271/176; 271/180; 271/219

[58] Field of Search ..... 271/180, 181, 306, 176, 271/219

[56] References Cited

U.S. PATENT DOCUMENTS

| | | | |
|---|---|---|---|
| 4,765,607 | 8/1988 | Zouzoulas | 271/181 X |
| 4,844,446 | 7/1989 | Thie | 271/181 X |
| 4,951,934 | 8/1990 | Prins | 271/181 |
| 4,997,176 | 3/1991 | Hain | 271/180 |

*Primary Examiner*—Richard A. Schacher
*Attorney, Agent, or Firm*—Bauer & Schaffer

[57] ABSTRACT

A bill accumulating storage unit is provided for use with a paper currency acceptor, the storage unit comprising a presser plate on one side of the currency pathway therein and a spring loaded currency support platform on the opposite side of the currency pathway. The presser plate is pivotably mounted to the eccentric center section of one or more cranks having concentric end sections journalled for rotation in the walls of the storage unit. Elongated stacker arms are mounted at a first end to a concentric end of the crank for conjoint rotation therewith. The second end of the stacker arm is coupled to a motorized rotatable drive cam at a location offset from the axis of rotation of the cam so that when the cam is rotated, stacker arms reversingly rotate the cranks so that the presser plate is forced by the eccentric crank center sections to pass through the currency pathway and into the storage area and back, causing a piece of paper currency in the pathway to be transferred by the presser plate into the storage area and to be secured therein by spring loaded platform as the presser plate returns to its starting position. The drive cam has a detent in its circumference which responsively engages the actuator of a microswitch as the cam reaches a position corresponding to the presser plate returning to its starting position.

4 Claims, 2 Drawing Sheets

BILL ACCUMULATING AND STACKING DEVICE

FIELD OF THE INVENTION

The present invention relates to paper currency acceptors and, more particularly, to a bill accumulating and stacking device for use in conjunction with a paper currency acceptor.

BACKGROUND OF THE INVENTION

Paper currency acceptors have become well known in these days of escalating prices. Their usage is commonly applied to vending machines and the like, which often require the deposit of money in amounts inconvenient to carry in coin. Since these units can accept money, it is desirable for these units to employ a device for the accumulation and storage of accepted bills so that extended periods of unattended currency collection is possible. Examples of such currency acceptors and storage units can be found in U.S. Pat. Nos. 4,884,671; 4,540,081; 4,011,931; 4,418,824; and 4,678,072.

The bill accumulating storage units illustrated in the aforementioned references suffer a number of disadvantages. The most common of these disadvantages is the design of the storage units in a manner which makes them an integral component of the currency accepting device. Consequently, those bill storage mechanisms cannot be retrofitted to other currency acceptors.

Furthermore, many of the prior designs employ extremely complex mechanisms to push the accepted bill from the bill passageway into the spring loaded storage section of the bill accumulator. Such devices are costly to manufacture and assemble and can require heightened maintenance, which further increase the cost of operation of these devices.

Other weaknesses of prior designs include the use of linear acting solenoids to motivate the bill pushing plates which must overcome the force of a spring loaded plate in the bill storage area. Since these solenoids are given a short pulse of power by the control circuitry to transfer the bill into the storage section from the bill pathway, there are no provisions for verifying that the solenoid and bill pusher have successfully traversed their full range of motion when pushing a bill into the storage section. This can become a particular problem when a number of bills have already accumulated in the storage section, thus causing the spring in the storage section to be at least partially compressed. In this condition, significantly higher effort is required from the solenoid to overcome that spring pressure when pushing subsequent bills into the storage area.

In other machines where a linear actuator is used, a spring is often used which is oriented opposite the actuation direction in order to return the bill pushing mechanism to a rest position out of the way of the bill accumulator inlet passageway. Here, again there are no provisions to verify that the actuator spring has fully returned the pusher mechanism to that rest position. Additionally, the orientation of the return spring opposite the actuation direction makes necessary the additional requirement that the solenoid exert even higher effort to overcome the return spring force when pushing a bill into storage section. This condition exacerbates the previously mentioned problem, requiring a larger and more costly solenoid to provide the elevated levels of effort necessary for operation.

OBJECTS AND ADVANTAGES

It is therefore an object of the present invention to provide a bill accumulating storage unit which can be retrofitted to a currency acceptor.

It is another object of the present invention to provide a bill accumulating storage unit for a currency acceptor which utilizes a simple mechanism which is inexpensive to manufacture and assemble.

It is also an object of the present invention to provide a bill accumulating storage unit for a currency acceptor which employs a mechanism which positively traverses the full range of travel in operation to insure that a transferred bill is pushed fully into the storage section thereof and to insure that the pusher mechanism fully retracts to a rest position so as not to obstruct the ingress of subsequent bills to the accumulating storage unit.

It is still another object of the present invention to provide a bill accumulating storage unit for a currency acceptor wherein the motive unit for transferring a bill to the storage section need not overcome the force of a return spring so that the size of the motive unit may be minimized.

Yet another object of the present invention is to provide a bill accumulating storage unit for a currency acceptor which has means for insuring and verifying that the full necessary range of mechanism travel has been traversed.

Other objects and advantages of the present invention will become obvious to those of skill in the art upon contemplation of the disclosure herein.

SUMMARY OF THE INVENTION

According to the present invention, a bill accumulating storage unit is provided for a paper currency acceptor having a presser plate for the displacement of bills from the bill pathway after its movement from the storage area comprising a motor driven disklike cam. The cam has a transverse central bore coupled to the drive motor output shaft. The cam also has an off-center bore transversely therethrough to which a first end of an elongated connecting arm is pivotably mounted to an elongated intermediate link at a substantially central location on the intermediate link. Each end of the intermediate link is connected to a first end of a stacker arm, and the second end of each stacker arm is coupled to a crank for rotation therewith. Each crank has an eccentric central portion which is pivotably journalled on the presser plate of the bill accumulating storage unit.

Thus, when the cam is rotated, eccentric rotary motion is imparted to the first end of the connected arm, which in turn alternately pulls and pushes the intermediate link, which through the stacker arms reverses rotation of the cranks. The eccentric center sections of the cranks in turn impart substantially reciprocating motion to the presser plate, causing the presser plate to pass through the bill pathway and into the storage area and then back to the starting position. Thus, the presser plate displaces a bill in the pathway to the storage area and automatically returns to a position clear of the pathway so that a subsequent bill may be received. The cam is further provided with a detent which responsively engages the actuator of a switch as the mechanism returns to the starting position so that the successful completion of a storage cycle is positively can be detected.

DESCRIPTION OF THE INVENTION

The present invention is applied to the structure of the acceptor and storage areas disclosed in my prior U.S. Pat. No. 4,884,671. Only those details necessary for understanding the invention are shown in the figures. Should any further details be required, reference thereto may be made, and the patent is incorporated herein as if more fully set forth.

Figure 1:
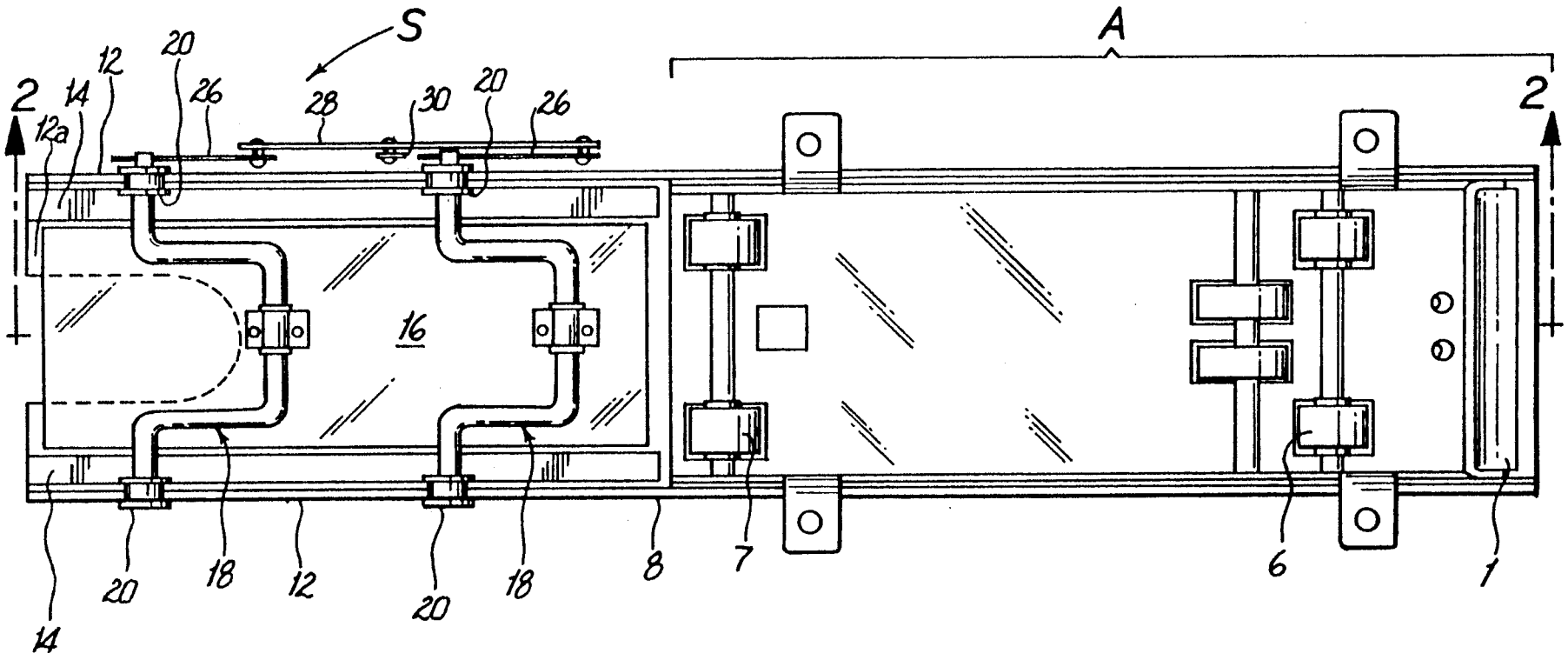
FIG. 1 is an elevational view of the acceptor and storage areas of a paper currency acceptor embodying the present invention.
Figure 2:
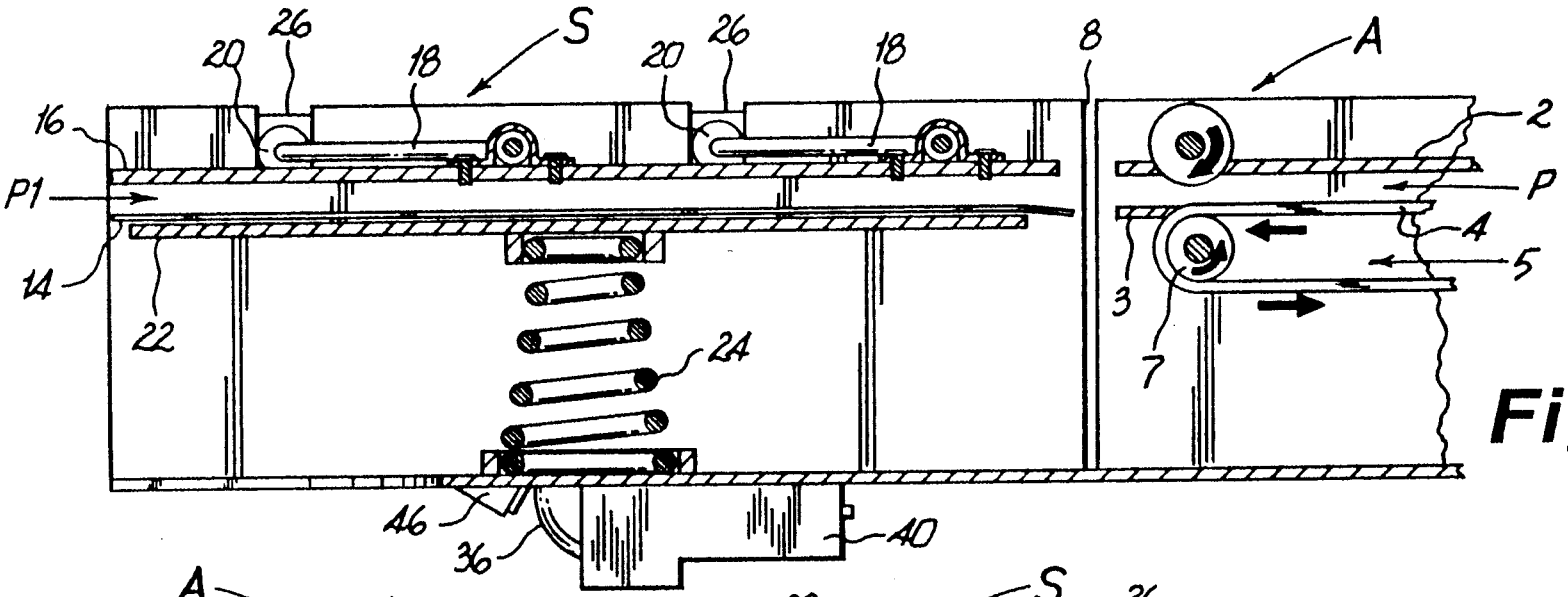
FIG. 2 is a sectional view of the side of the present invention taken along line 2—2 of FIG. 1 as annexed to a currency acceptor.

The inventive bill accumulating storage unit generally designated by the letter "S" is shown in FIG. 1, annexed to a paper currency acceptor as intended, the acceptor being generally designated by the letter A. Only so much of the acceptor A is as is needed to explain the present invention will be described herein. Reference should be made to my aforementioned previous patent for any additional details thereof. As seen in FIGS. 1 and 2, the acceptor A is aligned with the storage unit so that a bill received in the acceptor can be transported linearly from the inlet 1 through a planar pathway Pl defined by an upper plate 2 and a lower plate 3, over which the upper run 4 of an endless conveyor belt 5 moves. The belt is driver by a roller 6 and an opposed roller 7 so that at a selected time the bill is transferred across the gap 8 into the mouth of pathway P1 in the storage unit.

As shown in FIG. 2, the storage unit comprises a U-shaped trough-like housing comprising sides 12 and a bottom 12*a*. Extending inwardly from each side is a narrow rail 14 on which the bill fed from the acceptor rests. Above the rail 14 is located a presser plate 16 oriented substantially parallel to the planar surfaces of a paper currency bill C in the pathway P1. The presser plate 16 is pivotally mounted to the eccentric center sections of each of a pair of cranks 18 which are journalled at their concentric ends in bearings 20 set in the side walls 12 of the housing. Below the pathway P1 is a floating moveable paper currency stacking support platform 22, supported by one or more lightweight compression springs 24, the area between the platform 22 and pathway P1 defining the paper currency storage area. Reference to my aforementioned patent should be made for further details of the structure and operation of the acceptor and storage station as thus far described.

Figure 3:
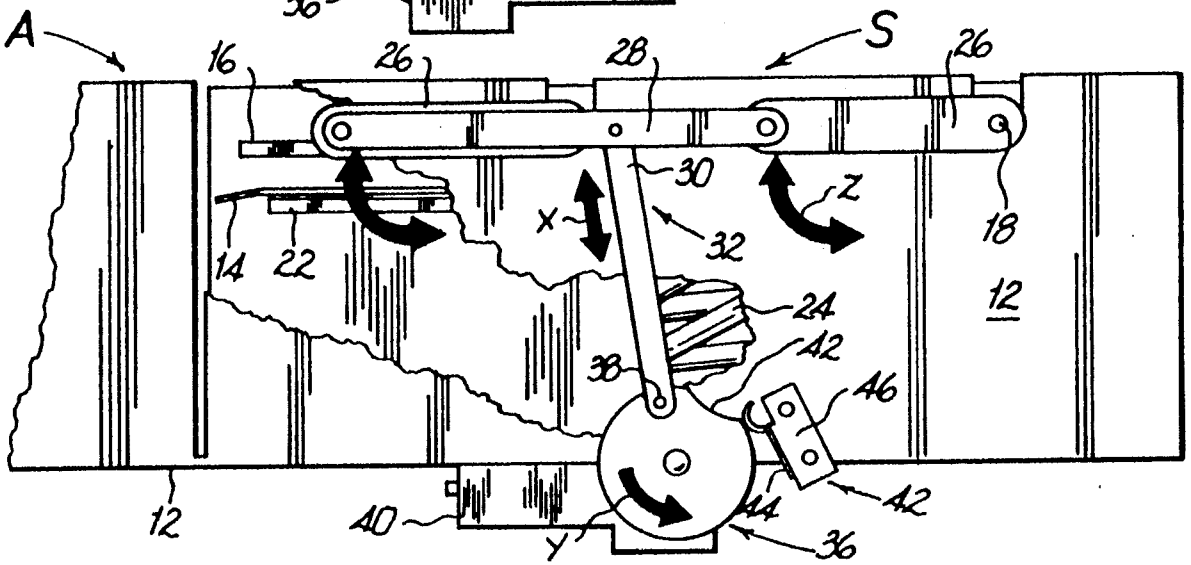
FIG. 3 is a side view of the stacker, partially in section, and viewed the opposite side of FIG. 2.

With reference to FIG. 2 and the details of FIG. 3, the means for raising and lowering the presser plate 16, according to the present invention, comprises an articulated linkage system including a pair of elongated short stacker links 26, each having a first end fixedly mounted for conjoint rotation to the concentric end of a crank 18 at a location outboard of the bearing 20. The second end of each stacker link 26 is pivotably journalled in opposite ends of an elongated intermediate link 28.

The elongated intermediate link 28 is connected at a location substantially in its center to the first end 30 of a connecting arm 32, which is eccentrically coupled at its opposite end 34 to a disklike rotatable cam 36 by means of pin 38 which projects at an orientation parallel to and offset from the axis of rotation of cam 36. The cam 36 is coupled at its axis of rotation to the output shaft of motor 40 for conjoint rotation therewith.

Thusly arranged, when cam 36 is rotated by the motor 40, pin 38 imparts motion (arrow X) to connecting arm 30, the motion being substantially circular (arrow Y) at the second end 38 of connecting arm 32. This motion is translated to the first end 30 of connecting link 28 and from there to each of the short links 26 where the motion arcuately reciprocates the short links 26 as shown by the arrow Z about the center of the cranks 18. The movement of the links 26 imparts to the ends of cranks 18 a rotary motion which causes the eccentric center sections to actuate the presser plate 16. On the downward stroke of the connecting arm 32 the presser plate 16 is depressed moving the presser plate 16 through pathway P1 and displaces support platform 22 downwardly, thereby moving any paper currency from rails 14 onto the platform 22 and downwardly into the currency storage area. This action corresponds to the first half revolution of cam 36 from the starting position shown in FIG. 3. As cam 36 traverses the second half revolution, i.e. moves into its upward stroke, the direction of motion of the first end of connecting arm 32, intermediate link 28, stacker links 26, cranks 18, and presser plate 16 is reversed, causing presser plate 16 to be moved upward through pathway P1, leaving the pathway P1 free to receive paper currency C from the acceptor. As the presser plate 16 passes the rails 14, the paper currency C deposited on the platform 22 assumes a flat horizontal condition. As the presser plate 16 is further raised, the spring 24 forces the platform upward so that the currency thereon is compressed against the bottom surface of the rails 14. Subsequent currency is moved from the pathway P1 in the same way and is stacked one on top of the other against support platform 22, and resiliently held in place by support springs 24. Upon this completion of a bill storage cycle, the pathway P1 is left unobstructed and ready to receive the next bill from acceptor A.

Also shown in FIG. 3 is a means for detecting the successful completion of a bill storage cycle, triggering the associated control circuitry for the deenergization of stacker motor 40 and ancillary enablement of acceptor A to process the next bill. This is implemented by the provision of detent 42 on the peripheral edge of the cam 36 into which a spring actuator 44 of microswitch 46 or the like falls as the cam 36 returns to its starting position.

While the above desription contains many specificties, these should not be construed as limitations on the scope of the present invention but rather as an exemplification of the preferred embodiment thereof. Accordingly, the scope of the instant invention should be determined by the claims appended hereto.

What is claimed is:

1. Apparatus for the accumulation and storage of paper currency for use in conjunction with a paper currency acceptor comprising:

a) a trough-like housing having a pathway therein adapted to receive bills of paper currency from the currency acceptor;

b) a moveable platform on one side of the pathway, said platform being oriented parallel to the planar surfaces of the currency in the pathway so as to define a variable volume bill storage area within said housing between said platform and the pathway;

c) spring means for biasing said platform toward the pathway;

d) a presser plate oriented parallel to said platform, said presser plate being movable from a starting position on the side of the pathway opposite said platform to a depressed position abutting said platform within said storage area;

e) at least one pair of cranks, each of said cranks having a pair of co-axial ends and a center section axially offset, said ends being journalled for rotation in the side walls of said housing, and said center sections of said cranks being pivotably mounted to said presser plate on the side of said presser plate opposite the pathway;

f) rotary drive means mounted exteriorly of said housing; and g) articulated linkage means coupling said cranks to said rotary drive means to cause said crank arms to reversingly rotate said cranks so that said presser plate passes from the starting position through the pathway and into the storage area and back again so that the paper currency in the pathway is displaced therefrom and into the storage area.

2. The apparatus according to claim 1, wherein said articulated linkage means comprises stacker link secured at one end to an end of each of said crank, a connecting link pivotally attached to the other end of each of said crank arms to link the two and an elongated drive arm pivotally coupled at one end to said connecting link and at its other end to said rotary drive means.

3. The apparatus according to claim 1, wherein said drive means comprises a unidirectional motor and a circular disk connected to the output thereof for conjoint rotation, the other end of said elongated drive arm being pivotally coupled to said disk.

4. The apparatus according to claim 1, wherein a sensing means comprises a detent in the circumference of a disk and a switch having an actuator oriented to responsively engage said detent as said disk reaches a position corresponding to the return of said presser plate to the starting position.

* * * * *